US007326262B2

(12) United States Patent
Eydoux et al.

(10) Patent No.: US 7,326,262 B2
(45) Date of Patent: Feb. 5, 2008

(54) MULTIFUNCTIONAL ADDITIVE COMPOSITIONS ENABLING MIDDLE DISTILLATES TO BE OPERABLE IN COLD CONDITIONS

(75) Inventors: Frank Eydoux, Saint Laurent d'Agny (FR); Philippe Flores, Chassieu (FR); Dominique Vichard, Versailles (FR); Laurent Germanaud, Heyraux (FR)

(73) Assignee: Elf Antar France (FR)

( * ) Notice: Subject to any disclaimer, the term of this patent is extended or adjusted under 35 U.S.C. 154(b) by 140 days.

(21) Appl. No.: 10/149,844

(22) PCT Filed: Dec. 27, 2000

(86) PCT No.: PCT/FR00/03697

§ 371 (c)(1),
(2), (4) Date: Nov. 18, 2002

(87) PCT Pub. No.: WO01/48122

PCT Pub. Date: Jul. 5, 2001

(65) Prior Publication Data

US 2003/0163951 A1 Sep. 4, 2003

(30) Foreign Application Priority Data

Dec. 28, 1999 (FR) ..... 99 16560

(51) Int. Cl.
*C10L 1/18* (2006.01)
*C10L 1/22* (2006.01)

(52) U.S. Cl. ..... 44/386; 44/387; 44/393; 44/408

(58) Field of Classification Search ..... 44/386, 44/387, 393, 408, 418, 419
See application file for complete search history.

(56) References Cited

U.S. PATENT DOCUMENTS 4,090,946 A * 5/1978 Nottes et al. ..... 208/48 AA
5,857,287 A * 1/1999 Schield et al. ..... 44/395

FOREIGN PATENT DOCUMENTS

WO WO 01/48122 7/2001

* cited by examiner

*Primary Examiner*—Cephia D. Toomer
(74) *Attorney, Agent, or Firm*—Townsend and Townsend and Crew LLP

(57) ABSTRACT

The invention concerns a multifunctional additive enabling fuels to be operable in cold conditions, consisting of copolymers of at least a dicarboxylic compound with at least an olefin, and whereon are grafted nitrogenous functions and/or esters of general formula (I) wherein: $R_1$ and $R_2$, and $R_4$ and $R_5$, $R_3$ and $R_6$ are hydrogen or alkyl radicals, and x is selected among the amine salts and N-alkylpolyalkylenepolyamines and their monohydroxylated and polyhydroxylated derivatives, N-alkylpolyalkylenepolyamine alkylesters and esters, and alkylamines and N-alkylpolyalkylenepolyamines.

15 Claims, No Drawings

MULTIFUNCTIONAL ADDITIVE COMPOSITIONS ENABLING MIDDLE DISTILLATES TO BE OPERABLE IN COLD CONDITIONS

The present invention concerns a novel multifunctional additive that improves the operability of middle distillates in cold conditions A particular aim is the improvement of the dispersing and anti-sedimentation properties and the lowering of the pour point and cloud point temperatures, but also an improvement in the cetane number of these distillates for use as a fuel in diesel engines and in fuels such as domestic fuel oil for boilers.

Cold operability corresponds to a limiting temperature at which the middle distillates may be used without problems of dogging. It lies between the cloud point temperature (ASTM D 2500-98) that characterises the onset of crystallisation of paraffins in the distillate and the pour point of the distillate (ASTM D 97-96a).

It is well known that the crystallisation of paraffins is a limiting factor in the use of middle distillates. Thus, it is important to prepare diesel fuels that are adapted to the temperatures at which they will be used in automotive vehicles, in other words the ambient conditions. Generally, cold operability of fuels at −10° C. is sufficient in many industrialised countries. However, in other countries, such as northern countries, Canada and the countries of northern Asia, fuels can be used at temperatures less than −20° C. The same is true for domestic fuel oils stored outside for individual houses and blocks of Flats.

This cold operability suitability of diesel fuels is important, especially when engines are started up from cold. If the paraffins crystallise at the bottom of the fuel tank, they can be drawn into the fuel circuit on start up and clog in particular the filters and pre-filters located upstream of the injection systems (pump and injectors). The same holds for the storage of domestic fuel oils; paraffins precipitate at the bottom of the tank and may be drawn into and obstruct the pipes upstream of the pump and the boiler feed system (jet and filter). It is obvious that the presence of solids, such as paraffin crystals, prevents the normal circulation of the middle distillate.

In order to improve their circulation either in the engine, or towards the boilers, several types of additive have been developed.

First of all, the oil industry concentrated on developing additives that favour the filterability of fuels at low temperatures. The role of these additives, called CFPP (cold filter plugging point) additives, is to limit the size of the paraffin crystals that are formed.

This type of additive, very widely known to those skilled in the art, is presently added systematically to middle distillates.

However these additives, although they regulate the size of the paraffin crystals, cannot prevent the sedimentation of the crystals formed, in other words their agglomeration, especially at the bottom of the fuel tanks in diesel vehicles when at rest or in the storage tanks of domestic fuel oils.

Thus, at a later stage, the oil industry did its best to develop anti-sedimentation additives, in other words dispersants, which maintain the paraffin crystals in suspension in the middle distillate, which avoids them depositing or agglomerating with each other. The applicant has, in particular, developed such an additive, described in patent EP 0 674 698.

Nevertheless, the combined action of CFPP and anti-sedimentation additives has not made it possible to improve the cold operability of all middle distillates produced in refineries from all known crude oils.

This is why the oil industry has developed a third type of additive with a view to lowering the cold operability temperature of middle distillates, whatever their type, including below −20 TC, even if their cloud point temperature is above −20° C. This is the case of the additives described in patents EP 0 722 481 and EP 0 832 172.

The aim of the present invention is a novel multifunctional additive that enables the cold operability temperature to be lowered and maintained down to temperatures below −20° C., and also to increase the cetane number of these distillates, without any sedimentation of the paraffins contained within the middle distillates.

The aim of the present invention is thus a multifunctional additive enabling fuels to be operable in cold conditions, consisting of copolymers with at least a dicarboxylic unit with at least an olefin unit and whereon are grafted nitrogenous functions and/or esters of general formula (I) hereafter:

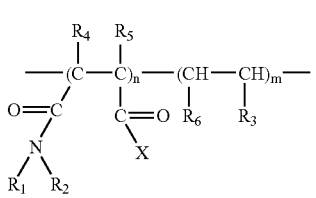

(I)

Wherein: $R_1$ and $R_2$, identical or different, are hydrogen or alkyl radicals containing from 1 to 20 carbon atoms, $R_3$ and $R_6$ are hydrogen or alkyl radicals containing from 1 to 30 carbon atoms, where $R_3$ is selected among alkyl groups containing from 10 to 30 carbon atoms when $R_6$ is hydrogen and vice versa, $R_4$ and $R_5$, identical or different, are hydrogen or an alkyl group containing 1 to 22 carbon atoms, n and m are whole numbers varying between 1 and 50, and X is selected among:

i) amine salts of the type

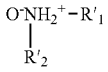

wherein $R'_1$ and $R'_2$, identical or different, are selected among alkyl groups containing from 1 to 18 carbon atoms, alkylamines containing from 1 to 18 carbon atoms, N-alkylpolyalkylene-polyamines of formula (II):

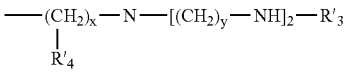

(II)

wherein $R'_3$ and $R'_4$, identical or different, are hydrogen or a linear or branched alkyl group containing from 1 to 22 carbon atoms, and x, y and z are whole numbers, x varying between 1 and 6 and y and z varying between 0 and 6, and mono and poly-hydroxylated amines and polyamines.

ii) esters —OR's, $R'_5$ selected among alkyl radicals containing from 1 to 30 carbon atoms and N-alkylpolyalkylene-polyamines of formula (II).

iii) and alkylamines containing from 1 to 44 carbon atoms and N-alkylpolyalkylene-polyamines of formula (II).

It has been observed that these multifunctional additives, when used alone or in mixtures, have, in an unexpected manner, both better dispersion properties and anti-sedimentation properties than known multifunctional additives for cold operability, a lowering of the pour point and also a lowering of the filterability temperature (or CFPP) and the cloud point of fuels, as well as an improvement in the cetane number.

According to the present invention, the copolymer of formula (I) is preferably a copolymer containing 45 to 65% mole of at least an olefin unit and 55 to 35% mole of at least a dicarboxylic unit. The dicarboxylic units are preferably selected among the group comprising maleic anhydride, citraconic anhydride and fumaric acid, and the olefin units selected among linear or branched alkenyl units containing from 1 to 30 carbon atoms. In a preferred embodiment, the copolymer is selected among maleic anhydride-octadecene, maleic anhydride-dodecene and maleic anhydride-hexadecene.

In the copolymer of formula (I), $R_1$ and $R_2$ are radicals preferably selected among the group comprising dodecyl and octadecyl radicals and $R_3$ is selected among alkyl groups containing from 10 to 20 carbon atoms.

A first additive according to the invention is the copolymer of formula (III) hereafter:

(III)

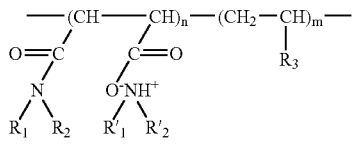

wherein $R'_1$ and $R'_2$, identical or different, are selected among alkyl radicals containing from 12 to 18 carbon atoms, alkylamines containing from 1 to 22 carbon atoms and N-alkylpolyalkylene-polyamines of formula (II) and hydroxylated amines from the group comprising diethanolamine, monoethanolamine, N-butylamine, N-decylethanolamine and N-dodecylethanolamine and their alkoxylated derivatives.

and $R'_3$ is selected among decyl, tetradecyl, hexadecyl, octadecyl and eicosyl radicals.

A second additive according to the invention is the copolymer of formula (IV) hereafter:

(IV)

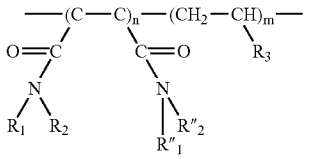

wherein:

$R'_1$ and $R'_2$, identical or different, are selected among alkyl radicals containing from 1 to 22 carbon atoms and N-alkylpolyalkylene-polyamines from the group comprising N-alkyldiethylene-triamines, N-alkyldipropylene-triamines, N-alkyltriethylene-tetramines, N-alkyltetraethylene-pentamines and N-alkyltetrapolypropylene-pentamines and $R'_3$ is selected among decyl, tetradecyl, hexadecyl, octadecyl and eicosyl radicals.

A third additive according to the invention is a copolymer of formula (V) hereafter:

(V)

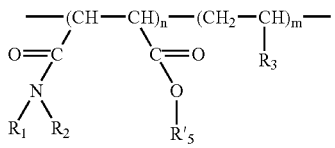

wherein:

$R'_5$ is selected among alkyl radicals containing from 6 to 18 carbon atoms and N-alkylpolyalkylene-polyamines of formula (II) from the group comprising N-alkyldiethylene-triamines, N-alkyldipropylene-triamines, N-alkyltriethylene-tetramines, N-alkyltetraethylene-pentamines and N-alkyltetrapropylene-pentamines and $R'_3$ is selected among decyl, tetradecyl, hexadecyl, octadecyl and eicosyl radicals.

According to the invention, the alkylamines and polyalkylene-polyamines of formula (II) are selected from the group comprising dibutylamine, didodecylamine, dioctadecylamine, N-alkylethylene-diamines, N-alkylpropylene-diamines, N-alkylbutylene-diamines, N-alkyldiethylenetriamines, N-alkyldipropylene-triamines, N-alkyldibutylene-triamines, N-alkyltriethylene-tetramines, N-alkyltripropylene-tetramines, N-alkyltributylene-tetramines, N-alkyltetraethylene-pentamines, N-alkyltetrapropylene-pentamines and N-alkyltributylene-pentamines with an alkyl radical containing from 12 to 22 carbon atoms, preferably N-dodecyidipropylene-triamine, N-octadecyidipropylene-triamine, N-ctadecyidiethylene-triamine and N-docosyldiethylene-triamine.

A second aim of the invention is a composition of additives comprising an additive of formula (I) and at least an additive selected among filterability additives and/or flow additives, cetane number improvement additives, catalytic combustion promoters and soot, detergents, lubricating additives, anti-wear additives, anti-foaming additives, anti-corrosion additives and other additives or additive compositions for improving the cloud point, the dispersion and the sedimentation of paraffins.

Among these additives, the following may be cited in particular:

a) cetane number improvement additives, particularly (but not Imitatively) selected among alkyl nitrates, preferably 2-ethylhexyl nitrate, aroyl peroxides, preferably benzyl peroxide, alkyl peroxides, preferably ter-butyl peroxide.

b) filterability additive, particularly (but not limitatively) selected among ethylene—vinyl acetate (EVA), ethylene—vinyl propionate (EVP), ethylene—vinyl ethanoate (EVE), ethylene—methyl methacrylate (EMMA) and ethylene alkyl fumarate copolymers. Examples of such additives are given in the following documents: EP-A-0187488, FR-A-2490669, EP-A-0722481 and EP-A-0832172.

c) anti-foaming additive, particularly (but not limitatively) selected among polysiloxanes, oxyalkylated polysiloxanes and the amides of fatty acids from vegetable or animal oils. Examples of such additives are given in the following documents: EP-A-0861182, EP-A-0663000 and EP-A-0736590.

d) detergent and/or anticorrosion additive, particularly (but not limitatively) selected among the group comprising amines, succinimides, alkenyl succinimides, polyalkylamines, polyalkyl-polyamines and polyetheramines. Examples of such additives are given in the following documents: EP-A-0938535.

e) lubrifying or anti-wear additive, particularly (but not imitatively) selected among the group comprising fatty acids and their ester or amide derivatives, especially glycerol mono-oleate, and the derivatives of mono- and poly-cyclic carboxylic acids. Examples of such additives are given in the following documents: EP-A-0680506, EP-A-0860494, WO-A-9804656, EP-A-0915944, FR-A-2772783 and FR-A-2772784.

f) cloud point additive, particularly (but not limitatively) selected among the group comprising long chain/(meth) acrylic ester/maleimide olefin terpolymers, and polymers of fumaric/maleic acid esters. Examples of such additives are given in the following documents: EP-A-0071513, EP-A-0100248, FR-A-2528051, FR-A-2528051, FR-A-2528423, EP-A-0 112195, EP-A-01 72758, EP-A-0271385 and EP-A-0291367.

g) anti-sedimentation additive, particularly (but not limitatively) selected among the group comprising (meth)acrylic acid/alkyl (meth)acrylate copolymers modified by a polyamine, polyamine alkenylsuccinimides and derivatives of phthalamic acid and double chain fatty amines. Examples of such additives are given in the following documents: EP-A-0261959, EP-A-00593331, EP-A-0674689, EP-A-0327423, EP-A-0512889 and EP-A-0832172.

h) multifunctional additive for cold operability selected among the group comprising olefin based polymers and alkenyl nitrate such as those described in EP 0 573 490.

A third aim according to the invention is a combustible, fuel and/or fuel oil containing a major part of a hydrocarbon base comprising petrols, middle distillates, synthetic fuels, animal or vegetable oils, esterified or not, and their mixtures, and a minor part, corresponding to 50 to 1000 ppm, of at least a multifunctional additive of formula (I). This additive may be present in the fuel or combustible with at least an additive from the group comprising cetane number improvement additives, catalytic combustion promoters and soot, detergents, lubricating additives, anti-wear additives, anti-foaming additives, anti-corrosion additives and other additives or additive compositions for improving the cloud point, the dispersion and the sedimentation of paraffins.

The following examples are given to illustrate the advantages of the present invention and are in nowise limitative.

EXAMPLE 1

The purpose of the present example is to illustrate the efficiency of the additives according to the invention in terms of filterability and flow in order to demonstrate the intrinsic properties of additives of formula (III), (IV) and (V), when they are used alone or when they are used in formulation with other additives.

The additive (III), referred to hereafter as additive 1, comprises a copolymer containing maleic anhydride units and ocadecene units in a 1/1 molar ratio, wherein $R_1$, $R_2$, $R'_1$ and $R'_2$ are identical and correspond to a dodecylamine radical.

The additive (IV), referred to hereafter as additive 2, comprises a copolymer containing maleic anhydride units and octadecene units in a 1/1 molar ratio, wherein $R_1$ and $R'_1$ are hydrogen atoms, $R_2$ is a butyl radical and $R'_2$ is a dodecyl radical.

The additive (V), referred to hereafter as additive 3, comprises a copolymer containing maleic anhydride units and octadecene units in a 1/1 molar ratio, wherein RI is a hydrogen atom, $R_2$ is an ethylamine radical and $R_2$ is a hexadecyl radical.

The above copolymers are generally obtained by the chemical modification of an alpha-olefin/maleic anhydride type copolymer, the alpha-olefin here being octadecene.

The octadecene/maleic anhydride copolymer is synthesized in solution in a solvent that is preferably aromatic (for example toluene or xylene). The length of the olefin chain varies between 13 and 30 carbons, and this monomer is radically copolymerised (in a molar ratio varying from 0.4 to 0.6) with maleic anhydride, in bulk or in solution. A peroxide, hydroperoxide or azonitrile type of initiator is generally used to control the molecular weight of the polymer at a concentration, by weight, of 0.5 to 5% of the total weight of monomers. Initiation is achieved in a thermal manner and preferably at temperatures between 60 and 140° C., and more precisely between 80 and 120° C. In order to obtain the amide, or amine salt, type of dicarboxylated structure, 2 molar equivalents of amine are reacted with 1 molar equivalent of anhydride, without raising the temperature too much so as not to obtain the diamide structure. The reaction temperature may vary from 20° C. to 90° C., and preferably from 40 to 80° C. In order to obtain the ester, an alcohol is subsequently made to react in comparable proportions.

Each additive was introduced into three different diesels with the characteristics shown in Table 1 below.

TABLE 1

| PROPERTY | Diesel 1 | Diesel 2 | Diesel 3 |
|---|---|---|---|
| Cloud point (° C.) | −5 | −3 | −1 |
| Cold filter plugging point (° C.) | −6 | −5 | −2 |
| Pour point (° C.) | −12 | −12 | −9 |
| Crystallisation temperature (° C.) | −8.9 | −5.60 | −9.85 |
| Percentage paraffin | 14.8 | 11.5 | 10.8 |
| Initial boiling point | 168 | 178 | 176 |
| Boiling point at 5% volume | 186 | 200 | 201 |
| Boiling point at 20% volume | 212 | 220 | 222 |
| Boiling point at 40% volume | 248 | 253 | 256 |
| Boiling point at 60% volume | 272 | 278 | 282 |
| Boiling point at 80% volume | 305 | 310 | 314 |
| Boiling point at 90% volume | 340 | 362 | 356 |
| Final boiling point | 354 | 370 | 363 |
| Density at 15° C. | 0.8355 | 0.8375 | 0.8483 |
| Hash point | 65 | 71 | 70 |
| Cetane number | 48.9 | 50.9 | 47.8 |

The cold operability results obtained with functional additives according to the invention when they are introduced at a level of 0.025% into the three diesels in Table (I) are given in Table (II) below.

TABLE II

| Sample | CFPP (° C.) | Gain/non-doped diesel (° C.) | PPT (° C.) | Gain/non-doped diesel (° C.) |
|---|---|---|---|---|
| Diesel 1 | −6 | — | −12 | — |
| Diesel 1 + additive "1" | −10 | 4 | −21 | 9 |
| Diesel 1 + additive "2" | −10 | 4 | −21 | 9 |

TABLE II-continued

| Sample | CFPP (° C.) | Gain/non-doped diesel (° C.) | PPT (° C.) | Gain/non-doped diesel (° C.) |
|---|---|---|---|---|
| Diesel 1 + additive "3" | −7 | 1 | −18 | 6 |
| Diesel 2 | −5 | — | −12 | — |
| Diesel 2 + additive "1" | −18 | 13 | −24 | 12 |
| Diesel 2 + additive "2" | −18 | 13 | −24 | 12 |
| Diesel 2 + additive "3" | −14 | 9 | −27 | 15 |
| Diesel 3 | −2 | — | −9 | — |
| Diesel 3 + additive "1" | −16 | 14 | −21 | 12 |

It can be seen from this table that whatever the additive 1, 2 or 3, one observes a systematic gain in the pour point temperature (PPT) whatever the diesel, and that the increase in the cold filter plugging point (CFPP) is especially marked in diesels 2 and 3.

Table (III) below shows the corresponding results of using these three additives in the same diesels but at a concentration of 0.0125% by weight, in combination with two filterability additives ($FI_1$ and $FI_2$) conventionally used for improving cold behaviour. These additives $FI_1$ and $FI_2$ are copolymers or mixtures of copolymers of the ethylene/vinyl acetate type, generally with a molecular weight varying between 5000 and 50 000 and in which the level of vinyl acetate varies from 25% to 32% by weight.

TABLE III

| Sample | CFPP (° C.) | Gain/non-doped diesel (° C.) | PPT (° C.) | Gain/non-doped diesel (° C.) |
|---|---|---|---|---|
| Diesel 1 | −6 | — | −12 | — |
| Diesel 1 + $Fl_1$ | −11 | 5 | −21 | 9 |
| Diesel 1 + $Fl_2$ | −15 | 9 | −21 | 9 |
| Diesel 1 + $Fl_1$ + additive "1 " | 17 | 11 | −24 | 12 |
| Diesel 1 + $Fl_2$ + additive "2" | −20 | 14 | −24 | 12 |
| Diesel 1 + $Fl_2$ + additive "3" | −18 | 12 | −24 | 12 |
| Diesel 2 | −5 | — | −12 | — |
| Diesel 2 + $Fl_1$ | −8 | 3 | −21 | 9 |
| Diesel 2 + $Fl_2$ | −12 | 7 | −21 | 9 |
| Diesel 2 + $Fl_1$ + additive "1" | −16 | 11 | −27 | 15 |
| Diesel 2 + $Fl_2$ + additive "2" | −16 | 11 | −30 | 18 |
| Diesel 2 + $Fl_2$ + additive "3" | −16 | 11 | −27 | 15 |
| Diesel 3 | −2 | — | −9 | — |
| Diesel 3 + $Fl_1$ | −12 | 10 | −18 | 9 |
| Diesel 3 + $Fl_1$ + additive "1" | −17 | 15 | −24 | 15 |

It can be seen from this table and the previous table that the additives according to the invention lead to a higher gain in the pour point than known FI additives. This gain is increased when additives 1, 2 and 3 are combined with one of the FI additives.

EXAMPLE 2

This example shows the anti-sedimentation properties of additives of formula (III), (IV) and (V) described in example 1 when they are introduced alone into the three diesels 1, 2 and 3 at a level of 0.025% by weight or in combination with two additives $FI_I$ and $FI_2$ at a concentration of 0.0125% by weight for each additive.

The efficiency of these additives is determined by applying the NF M07-085 (95) Standard and assigning a rating for the CFPP and the onset of crystallisation temperature (OCT). The results are shown in Table IV below.

TABLE IV

| Sample | Sedimentation (NF M07-085 (95) Standard) Visual reading | Delta OCT (° C.) | Delta CFPP (° C.) | "Zone" |
|---|---|---|---|---|
| Diesel 1 | 6O + C | 22.5 | 17 | C |
| Diesel 1 + additive "1" | cloudy | 3.2 | 2 | A |
| Diesel 1 + $Fl_1$ | 58 + C | 22.8 | 18 | C |
| Diesel 1 + $Fl_1$ + additive "1" | 114 + cloudy | 16.4 | 4 | B |
| Diesel 2 | 64 + C | 24.2 | 19 | C |
| Diesel 2 + additive "1" | Cloudy | 6.1 | 5 | A |
| Diesel2 + $Fl_1$ | 66 + C | 21.0 | 19 | C |
| Diesel 2 + $Fl_1$ + additive "1" | 187 + C 17.8 | 6 | B | |
| Diesel 3 | 58 + 0 | 23.4 | 19 | C |
| Diesel 3 + additive "1" | 232 + cloudy | 8.5 | 5 | A |
| Diesel 3 + $Fl_1$ | 58 + C | 23.0 | 19 | C |
| Diesel 3 + $Fl_1$ + additive "1" | 136 + cloudy | 10.7 | 6 | A |
| Diesel 1 + additive "2" | Cloudy | 5.5 | 5 | A |
| Diesel 1 + $Fl_2$ | 58 + C | 22.8 | 18 | C |
| Diesel 1 + $Fl_2$ + additive "2" | 150 + C | 15.1 | 9 | B |
| Diesel 2 + additive "2" | 162 + C | 11.2 | 8 | B |
| Diesel 2 + $Fl_2$ | 66 + C | 21.0 | 19 | C |
| Diesel 2 + $Fl_2$ + additive "2" | 168 + C | 9.7 | 10 | B |
| Diesel 1 + additive "3" | 236 + C | 4.3 | 5 | A |
| Diesel 1 + $Fl_2$ + additive "3" | 164 + cloudy | 10.2 | 13 | B |
| Diesel 2 + additive "3" | 172 + C | 14.1 | 10 | B |
| Diesel 2 + $Fl_2$ + additive "3" | 198 + c | 15.3 | 8 | B |

In this table, A corresponds to very little sedimentation, B to stability and C to a heavy sedimentation, visible to the naked eye.

From the results shown in this table, one can conclude that the additives 1, 2 and 3 provide an anti-sedimentation effect, reflected by a change in the assigned rating (C into A or C into B), whether they are used alone or in a mixture in each of the diesels in the presence of an Fl additive.

EXAMPLE 3

The present example illustrates the ability of the additives 1, 2 and 3 of the invention to lower the cloud point of diesels, whereby this cloud point corresponds to the onset of crystallisation temperature (OCT), determined according to the IP 389/90 Standard.

TABLE V

| Sample | OCT (° C.) |
|---|---|
| Diesel 1 | −8.6 |
| Diesel 1 + additive "1" | −9.7 |
| Diesel 1 + additive "2" | −10.0 |
| Diesel 2 | −4.1 |
| Diesel 2 + additive "1" | −5.3 |
| Diesel 2 + additive "2" | −5.2 |

It can be seen from this table that additives 1, 2 and 3 favour the lowering of the onset of crystallisation temperature (OCT) by at least 1° C., which represents, for those skilled in the art, an appreciable gain.

EXAMPLE 4

The present example illustrates the cetane number improvement effect provided by the additive of formula (III), used as such or as a mixture with ethyl-2-hexyl nitrate; this effect is measured by applying the ASTM-D613 Standard.

The results are given in Table VI hereafter for a concentration of 0.1% by weight of alkyl nitrate and 0.025% by weight of additive 1.

TABLE VI

| Sample | Cetane number (measured) | Gain/non-doped diesel |
|---|---|---|
| Diesel 1 | 48.9 | — |
| Diesel 1 + alkyl nitrate | 53.5 | 4.6 |
| Diesel 1 + additive "1" | 51.5 | 2.6 |
| Diesel 1 + alkyl nitrate + additive "1" | 55.0 | 6.1 |
| Diesel 2 | 50.9 | — |
| Diesel 2 + alkyl nitrate | 54.9 | 4.0 |
| Diesel 2 + additive "1" | 53.6 | 2.7 |
| Diesel 2 + alkyl nitrate + additive "1" | 56.7 | 5.8 |

The results in this table confirm that the additives according to the invention do indeed have a cetane number improvement effect, since they provide a gain of 2.6 to 2.7This improvement is higher when these additives according to the invention are introduced into the diesel with another cetane number improvement additive.

The invention claimed is:

1. Combustible, fuel and/or fuel oil, containing a major part of a hydrocarbon base comprising petrols, middle distillates, synthetic fuels, animal or vegetable oils, and their mixtures, and a minor part, from 50 to 1000 ppm, of at least one multifunctional additive enabling fuels to be operable in cold conditions, this additive comprising copolymers of at least one dicarboxylic compound with at least one olefin, having formula (I):

(I)

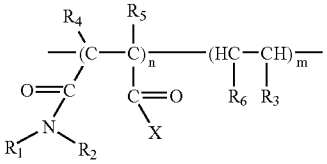

wherein $R_1$ and $R_2$ are radicals comprising dodecyl and octadecyl radicals; $R_3$ comprises an alkyl group containing from 4 to 20 carbon atoms and $R_6$ is hydrogen or an alkyl radical containing from 1 to 30 carbon atoms; where if $R_3$ contains from 12 to 30 carbon atoms then $R_6$ is hydrogen; $R_4$ and $R_5$, are identical or different, and correspond to hydrogen or an alkyl radicals containing from 1 to 22 carbon atoms, with n and m whole numbers varying between 1 and 50, and X comprises:

i) amine salts of the type:

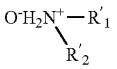

wherein $R'_1$ and $R'_2$, are identical or different, and are selected from the group consisting of alkyl groups containing from 1 to 18 carbon atoms, alkylamines containing from 1 to 18 carbon atoms, N-alkylpolyalkylene-amines of formula (II):

(II)

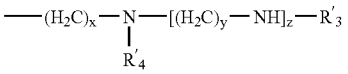

wherein $R'_3$ and $R'_4$, are identical or different, and are hydrogen or a linear or branched alkyl group containing from 1 to 22 carbon atoms, and x, y and z are whole numbers, x varying between 1 and 6 and y and z varying between 0 and 6, mono-hydroxylated amines, poly-hydroxylated amines, and polyamines;

ii) alkylamines containing from 1 to 44 carbon atoms, and N-alkylpolyalkylene-polyamines of formula (II); wherein when $R_6$ is hydrogen and $R_3$ is a tetradecyl, hexadecyl, octadecyl, or eicosyl group, then X is —$NR''_1R''_2$, in which $R''_1$ and $R''_2$ are either:

(a) identical or different, and are selected from the group consisting of:

alkylamines containing from 1 to 22 carbon atoms; and

N-alkylpolyalkylene-polyamines selected from the group consisting of N-alkyldiethylene-triamines, N-alkyldipropylene-triamines, N-alkyltriethylene-tetramines, N-alkyltetraethylene-pentamines and N-alkyltetrapropylene-pentamines, or (b) one of $R''_1$ and $R''_2$ is an alkyl group of 12 to 18 carbon atoms, and the other is either:

(1) alkylamines containing from 1 to 22 carbon atoms; or (2) N-alkylpolyalkylene-polyamines selected from the group consisting of alkyldiethylene-triamines, N-alkyldipropylene-triamines, N-alkyltriethylene-tetramines, N-alkyltetraethylene-pentamines and N-alkyltetrapropylene-pentamines; and the copolymer of formula (I) containing from 45 to 65 mole % of at least one olefin unit and from 55 to 35 mole % of at least one dicarboxylic unit.

2. Combustible, fuel and/or fuel oil according to claim 1, characterized in that X is an alkylamine containing from 1 to 44 carbon atoms.

3. Combustible, fuel and/or fuel oil according to claim 1, characterized in that the dicarboxylic units are anhydride units selected from the group consisting of maleic anhydride, citraconic anhydride and fumaric acid, and the olefin units comprise linear or branched alkenyl units containing from 1 to 30 carbon atoms.

4. Combustible, fuel and/or fuel oil according to claim 1, characterized in that the copolymer of the at least one dicarboxylic compound with the at least one olefin comprises maleic anhydride-octadecene, maleic anhydride-dodecene or maleic anhydride-hexadecene copolymers.

5. Combustible, fuel and/or fuel oil according to claim 1, characterized in that the alkylamines and the N-alkyl-polyalkylene-polyamines of formula (II) are selected from the group consisting of dibutylamine, didodecylamine, dioctadecylamine, N-alkylethylene-diamines, N-alkylpropylene-diamines, N-alkylbutylene-diamines, N-alkyldiethylene-triamines, N-alkyldipropylene-triamines, N-alkyldibuytlene-triamines, N-alkyltriethylene-tetramines, N-alkylpropylene-tetramines, N-alkyltributylene-tetramines, N-alkyltetraethylene-pentamines, N-alkyltetrapropylene-pentamines, N-alkyltributylene-pentamines with an alkyl radical containing from 12 to 22 carbon atoms, N-dodecyldipropylene-triamine, N-octadecyldipropylene-triamine, N-octadecyldiethylene-triamine, and N-docosyldiethylene-triamine.

6. Combustible, fuel and/or fuel oil according to claim 1, wherein the additive is a compound of formula (III):

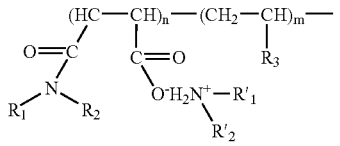

(III)

comprising a copolymer containing maleic anhydride units and octadecene units in a molar ratio of 1/1, wherein $R'_1$ and $R'_2$ are identical and correspond to a dodecylamine radical.

7. Combustible fuel and/or fuel oil according to claim 1, wherein:

X comprises alkylamines containing from 1 to 44 carbon atoms; and the copolymers are selected from the group consisting of maleic anhydride and octadecene; maleic anhydride and dodecene; and maleic anhydride and hexadecene.

8. Combustible fuel and/or fuel oil according to claim 7, wherein the copolymer is a compound of formula (III):

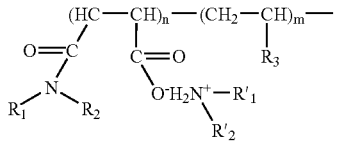

(III)

wherein $R'_1$ and $R'_2$ are identical or different, and $R'_1$ and $R'_2$ are selected from the group consisting of:

alkyl radicals containing 12 to 18 carbon atoms;

alkyl- and N-alkyl-polyalkylene-amines having formula (II); and hydroxylated amines selected from the group consisting of diethanolamine, monoethanolamine, N-decylethanolamine, N-dodecylethanolamine, alkoxylated derivatives of the hydroxylated amines; and $R_3$ is selected from the group consisting of tetradecyl, hexadecyl, octadecyl and eicosyl radicals.

9. Combustible, fuel and/or fuel oil according to claim 7, wherein the copolymer comprises a compound of formula (IV):

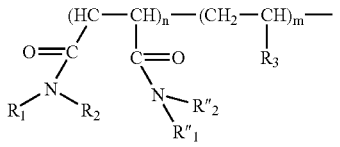

(IV)

wherein one of $R''_1$ and $R''_2$ is alkyl group of 12 to 18 carbon atoms, and the other is either:

(1) alkylamines containing 1 to 22 carbon atoms; or (2) N-alkylpolyalkylene-polyamines selected from the group consisting of N-alkyldiethylene-triamines, N-alkyldipropylene-triamines, N-alkyltriethylene-tetramines, N-alkyltetraethylene-pentamines, and N-alkyltetrapropylene-pentamines; and $R_3$ is selected from the group consisting of tetradecyl, hexadecyl, octadecyl and eicosyl radicals.

10. Combustible, fuel and/or fuel oil according to claim 7, wherein the copolymer comprises a compound of formula (IV):

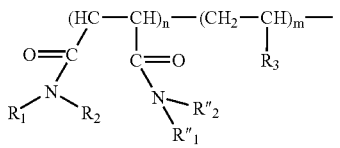

(IV)

wherein $—NR''_1R''_2$ comprises an alkylamine containing 1 to 44 carbon atoms; and $R_3$ is selected from the group consisting of tetradecyl, hexadecyl, octadecyl and eicosyl radicals.

11. Combustible, fuel and/or fuel oil, containing a major part of a hydrocarbon base comprising petrols, middle distillates, synthetic fuels, animal or vegetable oils, and their mixtures, and a minor part, from 50 to 1000 ppm, of at least one multifunctional additive enabling fuels to be operable in cold conditions, this additive comprising copolymers of at least one dicarboxylic compound with at least one olefin, having formula (III):

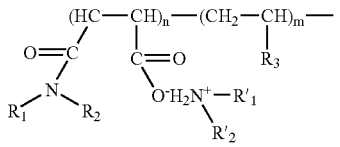

(III)

wherein $R_1$ and $R_2$ are radicals comprising dodecyl and octadecyl radicals;

$R'_1$ and $R'_2$ are identical or different, and comprise:

alkyl radicals containing from 12 to 18 carbon atoms, alkyl- and N-alkyl-polyalkylene-polyamines of formula (II); or hydroxylated amines selected from the group consisting of diethanolamine, monoethanolamine, N-decylethanolamine, N-dodecylethanolamine, and their alkoxylated derivatives; and $R_3$ comprises tetradecyl, hexadecyl, octadecyl or eicosyl radicals.

12. Combustible fuel and/or fuel oil according to claim 11, wherein the compound of formula (III) comprises a copolymer containing maleic anhydride units and octadecene units in a molar ratio of 1/1, wherein $R'_1$ and $R'_2$ are identical and correspond to a dodecylamine radical.

13. Combustible, fuel and/or fuel oil, containing a major part of a hydrocarbon base comprising petrols, middle distillates, synthetic fuels, animal or vegetable oils, and their mixtures, and a minor part, from 50 to 1000 ppm, of at least one multifunctional additive enabling fuels to be operable in cold conditions, this additive comprising copolymers of at least one dicarboxylic compound with at least one olefin, having formula (IV):

(IV)

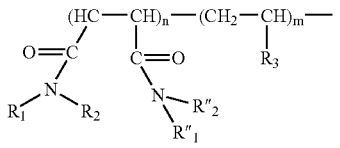

wherein $R_1$ and $R_2$ are radicals comprising dodecyl and octadecyl radicals;

$R''_1$ and $R''_2$ are identical or different, and comprise:

alkyl radicals containing from 12 to 18 carbon atoms, alkylamines containing from 1 to 22 carbon atoms, or N-alkyl-polyalkylene-polyamines selected from the group consisting of N-alkyldiethylene-triamines, N-alkyldipropylene-triamines, N-alkyltriethylene-tetramines, N-alkyltetraethylene-pentamines and N-alkyltetrapropylene-pentamines, and $R_3$ comprises a tetradecyl, hexadecyl, octadecyl, or eicosyl radical.

14. Combustible fuel and/or fuel oil according to claim 13, wherein one of $R''_1$ and $R''_2$ is an alkyl group of 12 to 18 carbon atoms, and the other is either:

(1) alkylamines containing from 1 to 22 carbon atoms; or (2) N-alkylpolyalkylene-polyamines selected from the group consisting of alkyldiethylene-triamines, N-alkyldipropylene-triamines, N-alkyltriethylene-tetramines, N-alkyltetraethylene-pentamines and N-alkyltetrapropylene-pentamines.

15. Combustible fuel and/or fuel oil according to claim 13, wherein $R''_1$ and $R''_2$ are identical or different, and are alkyl radicals with 12 to 18 carbon atoms.

* * * * *